US006364965B1

(12) United States Patent
Masuda et al.

(10) Patent No.: US 6,364,965 B1
(45) Date of Patent: Apr. 2, 2002

(54) ALUMINUM-CONTAINING MEMBER AND A METHOD FOR PRODUCING SUCH AN ALUMINUM-CONTAINING MEMBER

(75) Inventors: Masaaki Masuda, Nagoya; Taketoshi Tsutsumi, Mie Pref.; Yuji Katsuda, Tsushima, all of (JP)

(73) Assignee: NGK Insulators, Ltd. (JP)

( * ) Notice: Subject to any disclaimer, the term of this patent is extended or adjusted under 35 U.S.C. 154(b) by 0 days.

(21) Appl. No.: 09/497,892

(22) Filed: Feb. 4, 2000

(30) Foreign Application Priority Data

Feb. 4, 1999 (JP) ..... 11-027924
Mar. 5, 1999 (JP) ..... 11-059011

(51) Int. Cl.[7] ..... C23C 8/24
(52) U.S. Cl. ..... 148/223; 148/238
(58) Field of Search ..... 148/223, 238

(56) References Cited

U.S. PATENT DOCUMENTS

| | | | | | |
|---|---|---|---|---|---|
| 4,451,302 | A | | 5/1984 | Prescott et al. | 148/13.1 |
| 4,522,660 | A | | 6/1985 | Suzuki et al. | 148/20.3 |
| 4,597,808 | A | | 7/1986 | Tachikawa et al. | 148/20.3 |
| 4,612,045 | A | * | 9/1986 | Shintaku | 75/68 R |
| 4,909,862 | A | * | 3/1990 | Tachikawa et al. | 148/20.3 |
| 5,514,225 | A | * | 5/1996 | Yamada et al. | 148/238 |
| 5,582,655 | A | * | 12/1996 | Yamada et al. | 148/317 |
| 5,605,741 | A | * | 2/1997 | Hite et al. | 428/216 |
| 5,683,606 | A | * | 11/1997 | Ushikoshi et al. | 219/544 |
| 5,888,269 | A | * | 3/1999 | Yamada et al. | 75/252 |
| 6,074,494 | A | * | 6/2000 | Miura et al. | 148/238 |

FOREIGN PATENT DOCUMENTS

| | | | | |
|---|---|---|---|---|
| DE | 198 15 019 | | 10/1999 | |
| EP | 0 666 334 | A1 | 10/1994 | |
| EP | 0 795 621 | A1 | 9/1997 | |
| FR | 2 719 057 | | 10/1995 | |
| JP | 60-211061 | | 10/1985 | |
| JP | 7-166321 | | 6/1995 | |
| JP | 11-137735 | A * | 5/1999 | A63B/53/04 |

* cited by examiner

*Primary Examiner*—Roy King
*Assistant Examiner*—Harry D. Wilkins, III
(74) *Attorney, Agent, or Firm*—Parkhurst & Wendel, L.L.P.

(57) ABSTRACT

A method for producing an aluminum-containing member, comprising the steps of heating a substrate containing at least metallic aluminum in vacuum of not more than $10^{-3}$ torrs, and continuing with the heating step, forming a nitride in a surface portion of the substrate by heating/nitriding the substrate in a nitrogen atmosphere continuously to the above heating step.

8 Claims, 5 Drawing Sheets

ALUMINUM-CONTAINING MEMBER AND A METHOD FOR PRODUCING SUCH AN ALUMINUM-CONTAINING MEMBER

BACKGROUND OF THE INVENTION

1. Field of the Invention

The present invention relates to a method for producing aluminum-containing members and such aluminum-containing members. More specifically the present invention relates to a method for producing aluminum-containing members to be favorably used in semiconductor-producing devices, liquid crystal-producing devices, etc. and such aluminum-containing members.

2. Related Art Statement

As wirings in the semiconductors and liquid crystal panels become finer, fine workings with dry processings are progressing. With the demand for such fine workings, a halogen-based corrosive gas is used as a film-forming gas or an etching gas for the semiconductors or the like.

On the other hands, it is known that aluminum nitride exhibits high corrosion resistance against such a halogen-based corrosion gas. Therefore, members having aluminum nitride on their surfaces have been used in semiconductor-producing apparatuses, liquid crystal panel-producing apparatuses, etc.

More specifically, there are available powdery aluminum nitride sintered materials, materials in which aluminum nitride is formed on a substrate by using a gas phase growing method such as CVD, and materials in which a surface of aluminum is modified and aluminum nitride is formed thereon.

When aluminum contacts air, its surface is oxidized to form a thin oxidized film. Since this oxidized film is an extremely stable passive phase, the aluminum surface could not be nitrided by a simple nitriding method. Under the circumferences, the following method has been developed to modify the surface of aluminum and form aluminum nitride thereon.

JP-A 60-211,061 discloses a method in which after the inner pressure of the chamber is reduced to a given pressure and hydrogen is introduced thereinto, discharging is effected to heat the surface of a member of such as aluminum to a given temperature, further argon gas is introduced and discharging is effected to activate the surface of the member, and the surface of the aluminum member or the like is ionically nitrided through introducing nitrogen gas.

JP-A 7-166,321 discloses a method in which a nitriding aid made of aluminum powder is contacted with the surface of the aluminum, and since aluminum nitride is formed on the surfaces of aluminum nitride through heating in the nitrogen atmosphere.

However, according to the method described in JP-A 60-211,061, since aluminum nitride is formed by using discharging, the entire device is complicated to raise the cost. Further, it is difficult for this method to members having complicated shapes or large sizes.

Furthermore, according to a method described in JP-A 7-166,321, since a nitriding aid is used, voids exist in a resulting surface layer of aluminum nitride so that denseness is not sufficient. For this reason, it is an actual situation that corrosion resistance against the halogen-based corrosive gas is not sufficient and cannot be said to be practically satisfactory.

Further, if aluminum nitride is formed by sintering, aluminum nitride powder needs to be sintered at a high temperature and the sintered body is difficult to be worked, thereby raising the cost. Further, it was extremely difficult to form members having large sizes or complicated shapes.

In the case that aluminum nitride is formed by CVD process, the producing device and process are complicated and precious, it is also difficult to members having large sizes or complicated shapes.

SUMMARY OF THE INVENTION

It is an object of the present invention to provide a method for forming a nitride on a surface of a given substrate in a simple manner and to provide an aluminum-containing member having a high corrosion resistance against a halogen-based corrosive gas.

The present invention relates to a method for producing an aluminum-containing member, comprising the steps of heating a substrate containing at least metallic aluminum in vacuum of not more than $10^{-3}$ torrs, and forming a nitride in a surface portion of the substrate by heating/nitriding the substrate in a nitrogen atmosphere, continuing with said heating step.

The present invention also relates to an aluminum-containing member comprising a substrate containing at least metallic aluminum, and a nitride in a surface portion of the substrate, wherein the nitride contains at least one element selected from the group consisting of metals of Group 2A, Group 3A, Group 4A and Group 4B in Periodic Table at a higher concentration than that in a metallic aluminum-containing portion in the substrate.

These and other objects, features and advantages of the invention will be appreciated upon reading of the following description of the invention when taken in conjunction with the attached drawings, with understanding that some modifications, variations and changes of the same could be easily made by the skilled person in the art to which the invention pertains.

BRIEF DESCRIPTION OF THE ATTACHED DRAWINGS

For a better understanding of the invention, reference is made to the attached drawings, wherein.

Figure 4:
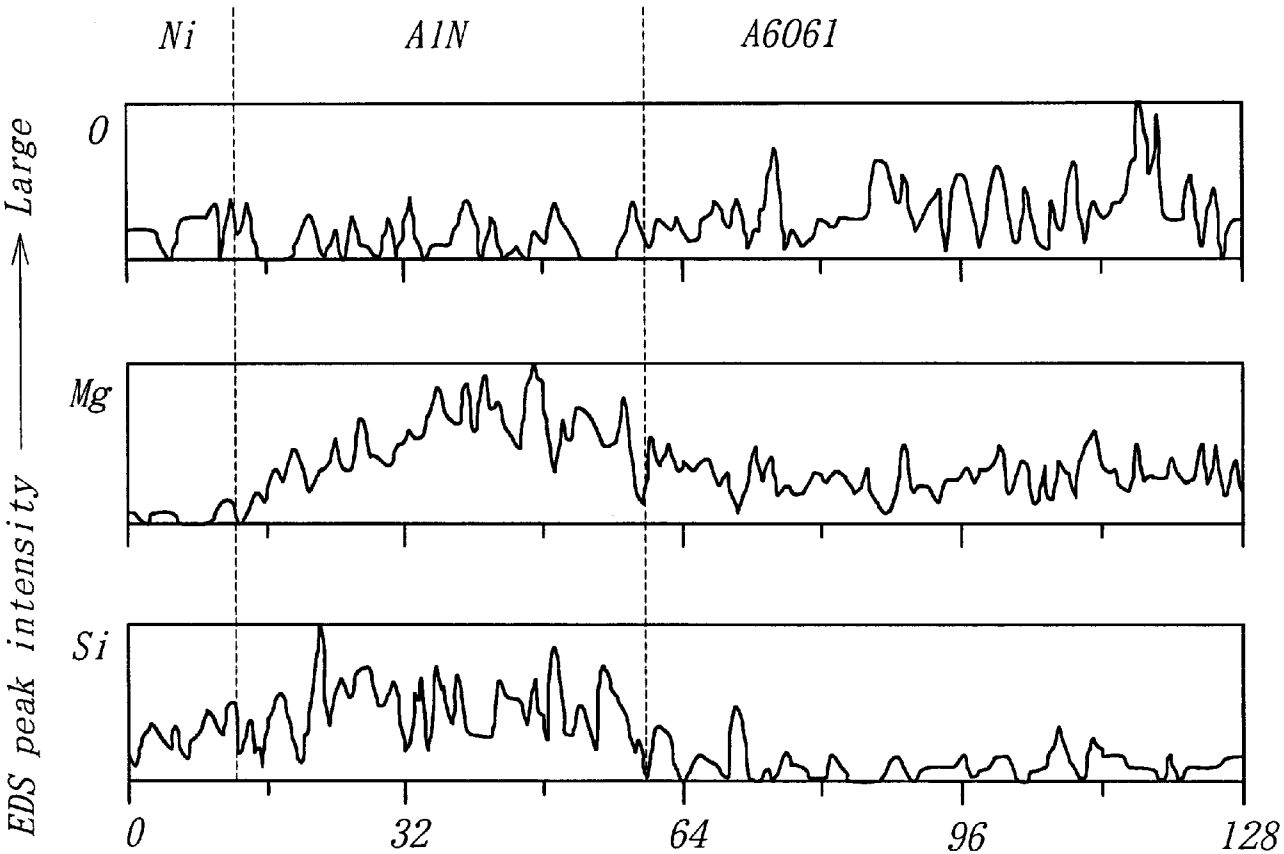
Figure 5:
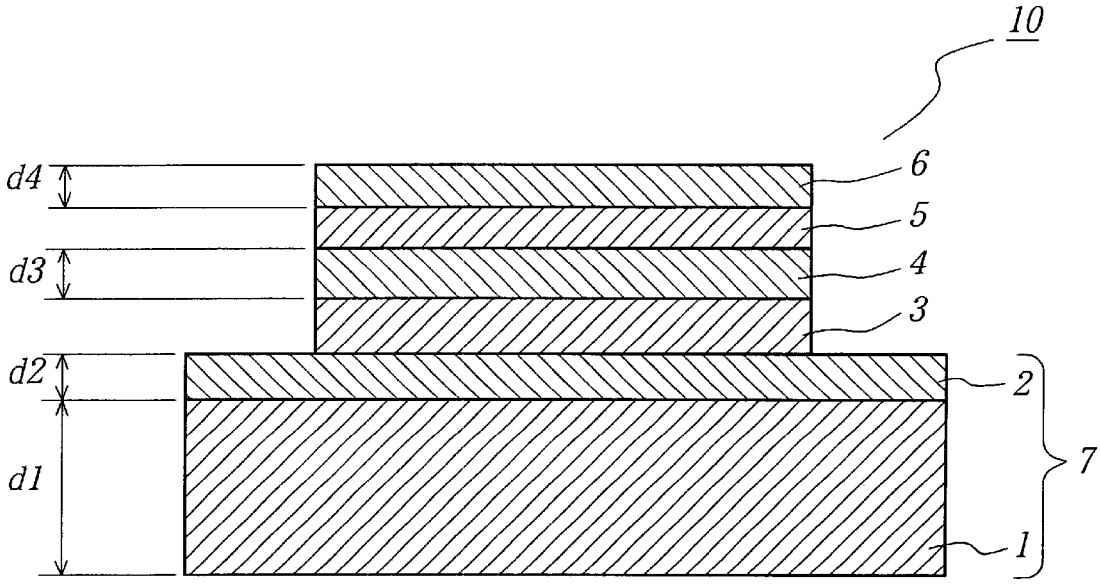

FIG. 4 gives diagrams for showing intensities of EDS peaks of surfaces of aluminum-containing members according to the present invention; and FIG. 5 is a sectional view of an embodiment of a heat emission member using an aluminum-containing member.

DETAILED DESCRIPTION OF THE INVENTION

The present inventors have strenuously and repeatedly conducted investigations to discover a new method for forming a nitride in a surface portion of an aluminum substrate in a simple manner. In the prior art, three steps are required to form a nitride film on the surface of the aluminum substrate, which steps includes (1) heating the substrate, (2) removing a film of the oxide from the surface of the substrate, and (3) effecting the nitriding treatment for the substrate. Contrary to this, the present inventors discovered that a film of an oxide is unexpectedly removed from a surface of the aluminum substrate only by controlling the vacuum degree in heating the aluminum substrate to a high level and that a nitride film may be formed on the substrate from which the oxide film is thus removed. The present inventors reached the present invention based on this discovery. Although a reason for this is not clear, it is considered that an aluminum passive film on the surface of the aluminum substrate is removed by heating at a high vacuum degree.

Figure 1:
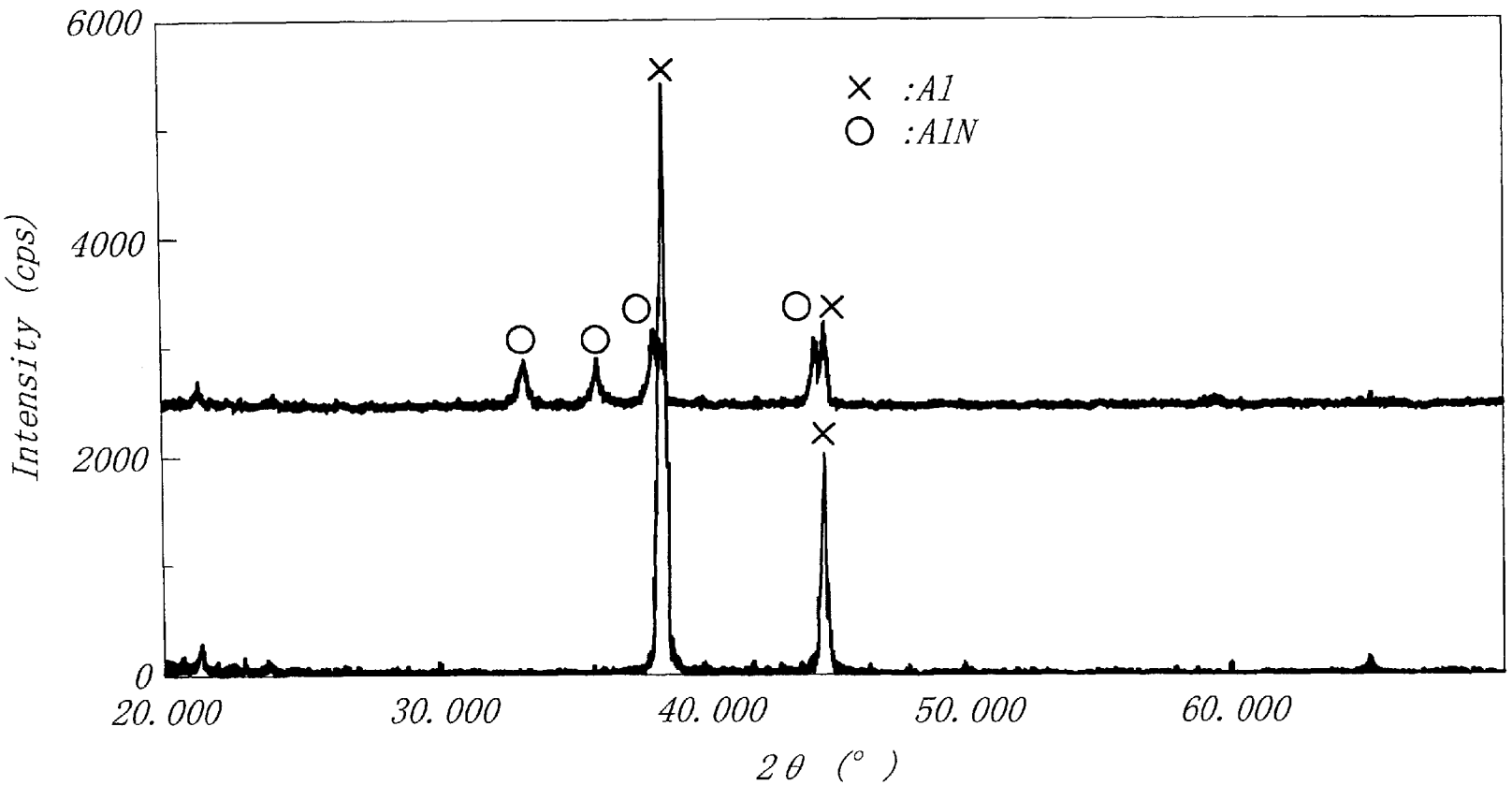
FIG. 1 is a diagram showing an X-ray diffraction pattern of a surface of an aluminum-containing member produced by the producing process according to the present invention.

A substrate made of pure aluminum (Al050:Al content>99.5 wt. %) was heated at 540° C. for 2 hours together with Mg—Si based alloy (A6061) under a vacuum degree of $2\times10^{-4}$ torr. Then, after $N_2$ gas was introduced to reach a pressure of 8.0 kgf/cm$^3$, they were heated at 555° C. for 2 hours, thereby forming a nitrided film at the surface of the substrate. FIG. 1 is a diagram showing an X-ray diffraction pattern of the surface of the thus obtained member and that of the original aluminum substrate.

From the X-ray diffraction pattern in FIG. 1, peaks attributable to aluminum nitride are observed in addition to those to aluminum. Therefore, it is seen that aluminum nitride is formed at the surface of the member.

Figure 2:
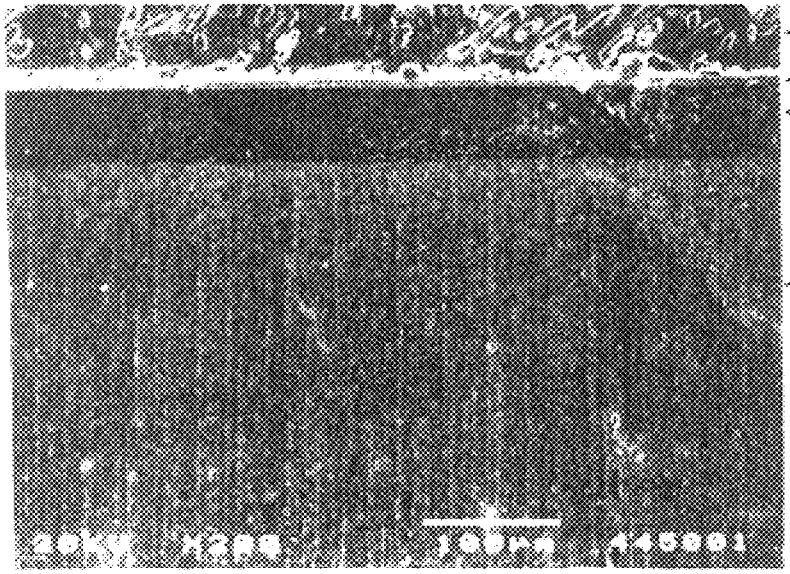
FIG. 2 is an SEM photograph showing a section of the aluminum-containing member produced by the producing process according to the present invention.

FIG. 2 is an SEM photograph of a polished section of the member in FIG. 1. It is observed that a thin layer is formed on the surface of the substrate. Therefore, it is seen that the above aluminum nitride is formed in the form of a layer or a film of aluminum nitride. Further, it is seen that no voids are recognized in the aluminum nitride film and that the film has high denseness.

According to the present invention, since a passive film represented by alumina is removed from the surface of the substrate and the nitrided film is directly formed on the surface portion of the substrate, the nitrided film having high adhesion can be formed.

Further, since the nitrided film can be formed by the heat treatment only, the entire apparatus can be in a simple structure. As a result, the production cost can be also reduced.

Figure 3:
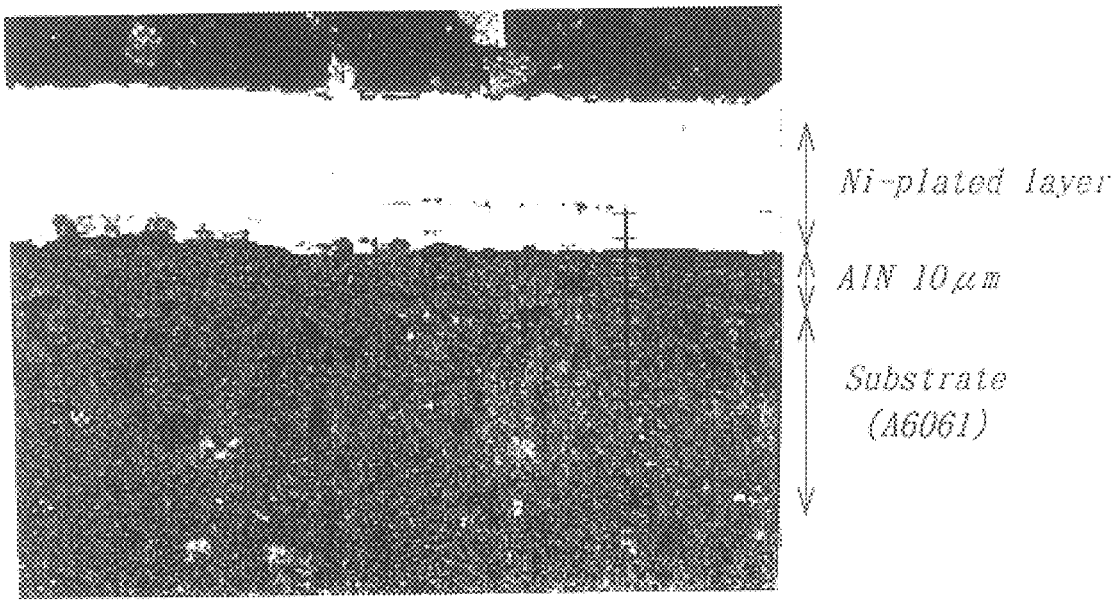
FIG. 3 is a an SEM photograph showing a section of an aluminum-containing member according to the present invention.

A substrate made of a Mg—Si based aluminum alloy (A6061: Al content >99 wt. %) was heated at 540° C. for 2 hours under a vacuum degree of $1.8\times10^{-4}$ torr. Then, after $N_2$ gas was introduced to reach a pressure of 9.5 kgf/cm$^3$, the substrate was heated at 540° C. for 2 hours, thereby forming a film of aluminum nitrided film at the surface of the substrate. FIG. 3 is a diagram showing an SEM photograph of a section of the thus obtained member. From this, it is clear that a film of aluminum nitride is formed in a thickness of about 10 $\mu$m when the Mg—Si based aluminum alloy was used.

FIG. 4 gives diagrams showing intensities of EDS peak at the surface of the member thus obtained.

It is seen from FIG. 4 that the content of Si falling Group 4B in the Periodic Table and that of Mg as Group 2A in Periodic Table in the aluminum nitride are greater than those in the A6061 alloy, respectively. It is considered that if the nitride such as aluminum nitride contains Si or the like falling in Group 4B of the Periodic Table and that of Mg or the kin Group 2A of Periodic Table in the aluminum nitride are greater than those in the substrate, respectively, promotes nitriding of Al.

It is seen from FIG. 4, it is seen that the aluminum nitride contains oxygen at a concentration lower than that of a metallic aluminum-containing portion in the substrate made of the A16061 alloy, and that oxygen is uniformly distributed in the film. Owing to this, it is seen that the nitride formed at the surface of the substrate, such as aluminum nitride, uniformly occur.

As shown in the following Examples, the consolidation of the above two effects makes the nitride formed at the surface of the substrate to have a high hardness and extremely excellent corrosion resistance.

The term "continuously" means that the heating/nitriding is effected without interposition of any other step after the heating step in vacuum, while this vacuum is being kept.

In the following, embodiments of the present invention will be explained based on specific embodiments of the present invention.

According to the aluminum-containing member-producting process of the present invention, a substrate containing at least aluminum is heated in vacuum of not more than $10^{-3}$ torrs, and preferably not more than $5\times10^{-3}$ torrs, and preferably $5\times10^{-4}$ torrs.

Further, the lower limit of the pressure in vacuum in the heating step is not particularly limited, it is preferably $10^{-6}$ torrs, more preferably $10^{-5}$ torrs. In order to attain a higher vacuum degree, a large size of a pump and a chamber corresponding to such a higher vacuum degree is necessary to raise the cost. Further, such a higher vacuum degree will not effect any more influence upon the nitride-forming speed.

The lower limit for the temperature of the heating treatment is not particularly restricted, so long as the nitride can be formed on the surface of the substrate. However, in order to readily form the nitride in a short time, it is preferably 450° C., and more preferably 500° C.

Further, the upper limit of the temperature in the heating treatment is not particularly restricted. However, it is preferably 450° C., and more preferably 500° C. By so setting, the substrate containing aluminum can be prevented from being thermally deformed.

According to the aluminum-containing member-producing process of the present invention, after the substrate is heated in vacuum, continuously it is heated and nitrided in the nitrogen atmosphere.

The term "continuously" means the meaning already mentioned before.

As the nitrogen atmosphere in this heating/nitriding treatment, $N_2$ gas, $NH_3$ gas and $N_2/NH_3$ gas may be used.

In order to form in a short time a thick nitrided film on the substrate having undergone the heating treatment, the gas pressure of the nitrogen atmosphere is preferably set at not less than 1 kg/cm$^2$, and particularly preferably set in a range of 1.5 to 2000 kg/cm$^2$.

Further, the heating temperature in the heating/nitriding treatment is not particularly restricted, so long as the nitrided film can be formed on the surface of the substrate. However, in order to form a relatively thick nitrided film in a relatively short time as in the above, it is preferably 450° C., and more preferably 500° C.

Further, the upper limit of the temperature in the heating treatment is not particularly restricted. However, it is preferably 450° C., and more preferably 500° C. By so setting, the substrate containing aluminum can be effectively prevented from being thermally deformed as mentioned before.

The nitride thus formed on the surface of the substrate is not necessarily present in the form of a layer or film as shown in FIG. 2. That is, its configuration is not limited so long as the nitride affords corrosion resistance upon the substrate itself. Therefore, the nitride may be present in such a state that its fine particles are densely dispersed or the composition of nitride inclinedly varies in a direction toward the substrate with an interface of the nitride and the substrate being unclear.

In the producing process according to the present invention, a material which can be used for the substrate is required to contain at least aluminum. By using such a material, casting and sintering can be readily effected, so that a large size of a member for the semiconductor-producing apparatus can be readily formed. Further, a passing film of such as alumina is formed on the surface of the substrate if it is left in air. Therefore, the producing process according to the present invention can be favorably employed for this case.

The nitride formed on the surface of the substrate according to the producing process of the present invention preferably contains at least one element selected from the group consisting of metals of Group 2A, Group 3A, Group 4A and Group 4B in Periodic Table at a higher concentration than that in a metallic aluminum-containing portion in the substrate. The concentration of the oxide in the nitride is preferably lower than that in the substrate. In this case, the nitriding is accelerated and the nitride is made uniform as mentioned before, so that the hardness of the nitride can be increased, and excellent corrosion resistance can be afforded upon the nitride.

The content of at least one element selected from the group consisting of metals of Group 2A, Group 3A, Group 4A and Group 4B in Periodic Table in the nitride is preferably not less than 1.1 times, more preferably not less than 1.5 as much as that in a metallic aluminum-containing portion in the substrate.

The above effects are more remarkably exhibited in the case that at least one element contained in the nitride comprises at least one of Mg and Si. Therefore, it is preferably that as at least one element selected from the group consisting of metals of Group 2A, Group 3A, Group 4A and Group 4B in Periodic Table, at least one of Mg belonging to Group 2A in Periodic Table and Si belonging to Group 4B in Periodic Table are preferred.

The content of oxygen in the nitride is not more than ⅔ times as much as that in the metallic aluminum-containing portion in the substrate.

Further, at least one element selected from the group consisting of metals of Group 2A, Group 3A, Group 4A and Group 4B in Periodic Table and oxygen are dispersed in the nitride uniformly in the thickness direction thereof from the standpoint of stabilizing the stress concentration, heat fatigue and mechanical properties.

As mentioned in the above, the nitride having the above oxygen content and at least one element selected from the group consisting of metals of Group 2A, Group 3A, Group 4A and Group 4B in Periodic Table has excellent corrosion resistance. For this reason, if the nitride is exposed to the above-mentioned corrosive gas, change in weight of the nitride is extremely small, particularly extremely smaller as compared with a case where the substrate is exposed to the corrosive gas.

In order that the nitride having the above oxygen content and at least one element selected from the group consisting of metals of Group 2A, Group 3A, Group 4A and Group 4B in Periodic Table has high hardness, high toughness and high corrosion resistance, the thickness of the nitride is preferably not less than 2 $\mu$m, mire preferably not more than 5 $\mu$m.

Since the substrate containing aluminum is used, the above-mentioned nitride is composed mainly of aluminum nitride in many cases. Since the main component of the nitride is aluminum nitride, the effect, i.e., low heat expansion and high heat conductivity can be obtained.

The aluminum-containing member according to the present invention needs to include the substrate containing at least aluminum. Further, in the case that the nitride has the above oxygen content and at least one element selected from the group consisting of metals of Group 2A, Group 3A, Group 4A and Group 4B in Periodic Table, the substrate is preferably at least one selected from aluminum, an aluminum alloy, a composite of aluminum and a low heat expansion material, and a composite of such an aluminum alloy and the low heat expansion material.

As the above low thermal expansion material is at least one selected from the group consisting of AlN, SiC, $Si_3N_4$, BeO, $Al_2O_3$, BN, Mo, W and carbon may be recited by way of example. These material function to form a network in the substrate containing aluminum to increase the rigidity of the substrate itself. The content of the low thermal expansion material is preferably 10 to 90%.

As the substrate, composite materials in which a member made of a metal, a ceramic material or a composite material thereof is surface-coated with aluminum or an aluminum alloy may be used.

Aluminum tends to form a thick and extremely tough passive film on its surface. Therefore, if aluminum and an aluminum alloy is used as the substrate, the above heating step and the above heating/nitriding step are preferably effected in an atmosphere containing a vapor of a material containing at least one selected from elements such as Mg, Sr, Ca, Ba and Be in Group 2A in the Periodic Table, elements such as Ce in Group 3A in the Periodic Table, elements such as Ti and Zr in Group 4A in the Periodic Table, and elements such as B and Si in Group 4B in the Periodic Table. By so doing, the removal of the passive film and the nitriding of aluminum can be effectively performed.

It is considered that oxygen at the surface of aluminum is absorbed with a metal vapor generated in the vacuum heating step and the nitride is formed during the heating/nitriding to accelerate the formation of the nitrided film.

The material to produce such a metal vapor is not limited so long as the above metal vapor can be formed therefrom. Specifically, in addition to the above metals alone, A6061 (Mg—Si based alloy) and A7075 (Zn—Mg based alloy) and A5083 (Mg based alloy) containing any of these metals may be recited by way of example. Preferably, any of these materials is coexistent with the substrate to be nitrided.

If any of such metals to accelerate the formation of the nitride film, such as A6061 (Mg—Si based alloy) and A7075 (Zn—Mg based alloy) and A5083 (Mg based alloy), such coexistence may be omitted.

When the nitride is formed on the surface of the substrate as mentioned above, the nitride can contain at least one element selected from the group consisting of metals of Group 2A, Group 3A, Group 4A and Group 4B in Periodic Table at a high concentration than the substrate. Further, the concentration of oxygen in the nitride can be made lower than that in the substrate.

The aluminum-containing member according to the present invention is produced as follows.

A given substrate is placed on a sample table inside a chamber equipped with a vacuum device including a diffusion pump. Next, this chamber is evacuated to a given vacuum degree by the vacuum device. Then, the member is heated to a given temperature by means of a resistant heat generator or an infrared lamp. The member is kept at this given temperature for 1 to 10 hours. In the heating treatment, the entire substrate does not need to reach this temperature, but at least a surface portion of the substrate on which a passive film is formed reaches this given temperature.

After the heating treatment, the interior of the chamber is replaced with nitrogen gas by introducing a nitrogen gas or the like thereinto. By adjusting the input power of the heater, the substrate is heated to a given temperature. Then, the member is at this given temperature for 1 to 10 hours. Also in this case, the entire substrate does not need to reach this temperature, but at least a surface portion of the substrate on which is to be nitrided reaches this given temperature.

After the given temperature passes, the heating and the introduction of the nitrogen gas are stopped to terminate the heating/nitriding treatment. Then, the interior of the chamber or furnace is cooled, and the member is taken out from it.

In the above, although the heating treatment and the heating/nitriding treatment is effected by the same batch, these treatments may be effected in different batches if they are continuously effected.

The aluminum-containing members according to the present invention can be used as members in the semiconductor-producing apparatuses, the liquid crystal-producing apparatuses, the automobiles, etc.

Further, the aluminum-containing member according to the present invention has excellent heat emission property. Therefore, the aluminum-containing member according to the present invention can be favorably used in heat emission parts requiring the heat emitting property.

FIG. 5 is a sectional view of an embodiment of a heat-emitting member using the aluminum-containing member according to the present invention.

In the heat-emitting member 10 shown in FIG. 10, a nitride 2 is formed on a substrate 1, and a substrate 4 made of aluminum nitride or silicon nitride is formed on the nitride 2 via a binder 3. A Si chip 6 is laminated on the substrate 4 via a binder 5. The substrate 1 and the nitride 2 constitute the aluminum-containing member 7 according to the present invention.

Since aluminum nitride and silicon nitride have high heat conductivity and high insulation, heat generated from the Si chip can be effectively removed by forming the substrate made of either of them on the aluminum-containing member 7 via the binder 3.

For this purpose, the heat conductivity of aluminum nitride used for the substrate 4 is preferably not less than 150 W/mK, more preferably not less than 180 W/mK. The-heat conductivity of silicon nitride to be used for the substrate 4 is preferably not less than 70 W/mK, more preferably not less than 80 W/mK. So long as the heat-generating member is concerned, the aluminum-containing member according to the present invention may be naturally applied to any member other than the Si chip.

As the binder 3, a brazing material or Al-10Si-1.5Mg (BA4004) is preferred. In this case, in order to ensure wettability between the soft solder or brazing material, some treatment may be required to form an Ni-plated film on the surface of the nitride 2. As the binder 5, a brazing material having a liquid phase temperature of 600° C. is preferably used. For instance, BA4004 or a soft solder may be used.

If the aluminum-containing member according to the present invention is used in the heat-emitting member 10 as shown in FIG. 5, the thickness of the nitride 2 is preferably not less than 2 $\mu$m, more preferably 5 to 20 $\mu$m

EXAMPLES

In the following, the present invention will be explained based on specific examples.

Examples 1 to 9

(Production of Aluminum-Containing Members)

As a substrate, pure aluminum having a shape 50×50×2 mm (Al050: Al content>99.5%) was used. This substrate and a Mg—Si based Al alloy (A6061) having the same shape as that of the substrate were placed in a graphite sheath inside an electric furnace made of graphite, and the electric furnace was evacuated to a vacuum degree given in Table 1 by means of a vacuum pump. Then, the substrate was heated to a temperature given in Table 1 by passing current through the heater, and the member was kept at this heating temperature for a time period given in Table 1.

Thereafter, $N_2$ gas was introduced into the electric furnace to reach a set pressure given in Table 1.

Afar the pressure reached the set level, the $N_2$ gas was introduced into the electric furnace at a rate of 2L/min., and control was effected to adjust pressure inside the furnace at the set level ±0.05 kg/cm$^2$. Then, while the temperature and the holding time of the substrate was set as shown in Table 1, a nitrided film was formed on the pure alumina substrate.

When the nitrided film-formed member was cooled to 50° C. or less, the member was taken out.

The surface of thus obtained member was brown or black. Inspection of the surface of the substrate by the X-ray diffraction revealed that peaks of aluminum nitride were observed to show that aluminum nitride was formed on the surface of the member.

On the other hand, observation of a section of the member with an SEM revealed that this aluminum nitride was present in the form of a layer. Measurement of the aluminum nitride film gave a value shown in Table 1.

(Peeling test)

The member formed with the aluminum nitride film was subjected to a peeling test to evaluate the adhesion of the aluminum nitride film. The peeling of the aluminum nitride film formed above was not observed, which revealed that the adhesion of the above aluminum nitride was extremely strong.

(Evaluation by heating cycling test)

The member formed with the aluminum nitride film was subjected to a heating cycling test to examine the adhesion strength of the aluminum nitride film.

The heating cycling test was effected at 10 cycles each having steps that heated the member from room temperature to 450° C. at a heating rate of 600° C. under a vacuum degree of $10^{-4}$ torrs, kept the member at 450° C. for 2 hours, cooling it to 100° C. at a cooling speed of 100° C.

Observation of the surface of the member having undergone the heating cycling test with SEM revealed occurrence of no cracks in the aluminum nitride film formed on the surface of the aluminum substrate.

Likewise, observation of a section of the above member with the SEM revealed no peeling of the aluminum nitride film. Further, a peeling test was effected by using a tape, but no peeling of the aluminum nitride was observed.

That is, it is seen that the nitride film formed according to the process of the present invention has extremely strong adhesion.

Comparative Examples 1 to 9

Comparative Examples 1 to 9 were effected in the same manner as in Examples 1 to 8 except that the vacuum degree, the heating temperature and the heating time was set as shown in Table 1, and the gas pressure of the nitrogen atmosphere, the heating temperature and the heating time were set as shown in Table 1.

Inspection of the surface of the thus obtained member with the X-ray diffraction revealed no peaks of aluminum nitride. Observation of a section of the member with the SEM revealed that no material was formed on the aluminum substrate.

Examples 1 to 9. As is clear from results shown in Table 2, the peeling of the aluminum nitride film formed above was not observed, which revealed that the adhesion of the above aluminum nitride film was extremely strong.

(Evaluation by heating cycling test)

The member formed with the aluminum nitride film was subjected to a heating cycling test in the same manner as in Examples 1 to 9 to examine the adhesion strength of the aluminum nitride film.

TABLE 1

| | | Coexisting material | Heating condition | | | Heating nitriding condition | | | | | |
|---|---|---|---|---|---|---|---|---|---|---|---|
| | Substrate used | Mg—Si based Al alloy | vacuum degree (torr) | heating temperature (° C.) | heating time (hour) | pressure of nitrogen gas atmosphere (kgf/cm$^2$) | heating temperature (° C.) | heating time (hour) | Kind of nitride | Thickness of nitride ($\mu$m) | Tape peeling |
| Example 1 | pure Al (A1050) | (A6061) | $1.1 \times 10^{-4}$ | 520 | 2 | 1.5 | 520 | 2 | AlN film | 3 | not peeled |
| Example 2 | pure Al (A1050) | (A6061) | $1.9 \times 10^{-4}$ | 540 | 2 | 1.5 | 540 | 2 | AlN film | 4 | not peeled |
| Example 3 | pure Al (A1050) | (A6061) | $1.2 \times 10^{-4}$ | 540 | 2 | 5.0 | 540 | 2 | AlN film | 10 | not peeled |
| Example 4 | pure Al (A1050) | (A6061) | $1.4 \times 10^{-4}$ | 540 | 2 | 8.0 | 540 | 2 | AlN film | 70 | not peeled |
| Example 5 | pure Al (A1050) | (A6061) | $1.8 \times 10^{-4}$ | 540 | 2 | 9.5 | 540 | 2 | AlN film | 100 | not peeled |
| Example 6 | pure Al (A1050) | (A6061) | $1.2 \times 10^{-4}$ | 540 | 4 | 9.5 | 540 | 4 | AlN film | 150 | not peeled |
| Example 7 | pure Al (A1050) | (A6061) | $1.2 \times 10^{-4}$ | 555 | 2 | 1.5 | 555 | 2 | AlN film | 5 | not peeled |
| Example 8 | pure Al (A1050) | (A6061) | $8.0 \times 10^{-5}$ | 580 | 2 | 9.5 | 580 | 2 | AlN film | 100 | not peeled |
| Example 9 | pure Al (A1050) | (A6061) | $9.0 \times 10^{-5}$ | 600 | 2 | 1.5 | 600 | 2 | AlN film | 10 | not peeled |
| Comparative Example 1 | pure Al (A1050) | (A6061) | $1.4 \times 10^{-2}$ | 520 | 2 | 1.5 | 520 | 2 | (**) | (**) | (**) |
| Comparative Example 2 | pure Al (A1050) | (A6061) | $1.2 \times 10^{-2}$ | 540 | 2 | 1.5 | 540 | 2 | (**) | (**) | (**) |
| Comparative Example 3 | pure Al (A1050) | (A6061) | $4.6 \times 10^{-2}$ | 540 | 2 | 5.0 | 540 | 2 | (**) | (**) | (**) |
| Comparative Example 4 | pure Al (A1050) | (A6061) | $1.8 \times 10^{-2}$ | 540 | 2 | 8.0 | 540 | 2 | (**) | (**) | (**) |
| Comparative Example 5 | pure Al (A1050) | (A6061) | (*) | (*) | (*) | 9.5 | 540 | 4 | (**) | (**) | (**) |
| Comparative Example 6 | pure Al (A1050) | (A6061) | $5.0 \times 10^{-3}$ | 540 | 6 | 9.5 | 540 | 4 | (**) | (**) | (**) |
| Comparative Example 7 | pure Al (A1050) | (A6061) | $5.8 \times 10^{-3}$ | 555 | 2 | 1.5 | 555 | 2 | (**) | (**) | (**) |
| Comparative Example 8 | pure Al (A1050) | (A6061) | $1.0 \times 10^{-2}$ | 580 | 8 | 9.5 | 580 | 2 | (**) | (**) | (**) |
| Comparative Example 9 | pure Al (A1050) | (A6061) | (*) | (*) | (*) | 1.5 | 600 | 4 | (**) | (**) | (**) |

(*) denotes no heating
(**) denotes no nitride formed

Examples 10 to 16

(Production of aluminum-containing members)

As a substrate made of an Al alloy, a Mg—Si based alloy having a shape of 50×50×2 mm (A6061), an Cu—Mg alloy (A2024), a Mg based alloy (A5083) and a Zn—Mg based alloy (A7075) were used. Examples 10 to 16 were effected in the same manner as in Examples 1 to 9 except that the vacuum degree, the heating temperature and the heating time in the heating treatment was set as shown in Table 2, and the gas pressure of the nitrogen atmosphere, the heating temperature and the heating time in the heating/nitriding treatment were set as shown in Table 2.

The surface of thus obtained member was brown or black. Inspection of the surface of the substrate by the X-ray diffraction revealed that peaks of aluminum nitride were observed to show that aluminum nitride was formed on the surface of the member. On the other hand, observation of a section of the member with an SEM revealed that this aluminum nitride was present in the form of a layer. Measurement of the thickness of the aluminum nitride film gave a value shown in Table 2.

(Peeling test)

The member formed with the aluminum nitride film was subjected to a peeling test in the same manner as in Observation of the surface of the member having undergone the heating cycling test with SEM revealed occurrence of no cracks in the aluminum nitride film formed on the surface of the aluminum substrate. Likewise, observation of a section of the above member with the SEM revealed no peeling of the aluminum nitride film. Further, a peeling test was effected by using a tape, but no peeling of the aluminum nitride was observed.

That is, it is seen that the nitride film formed according to the process of the present invention has extremely strong adhesion.

Comparative Examples 10 to 13

Comparative Examples 10 to 13 were effected in the same manner as in Examples 10 to 16 except that the vacuum degree, the heating temperature and the heating time in the heating treatment was set as shown in Table 2, and the gas pressure of the nitrogen atmosphere, the heating temperature and the heating time in the heating/nitriding treatment were set as shown in Table 2.

Inspection of the surface of the thus obtained member with the X-ray diffraction revealed no peaks of aluminum nitride. Observation of a section of the member with the SEM revealed that no material was formed on the aluminum substrate.

TABLE 2

| | | Heating condition | | | Heating nitriding condition | | | | | |
|---|---|---|---|---|---|---|---|---|---|---|
| | Substrate used | vacuum degree (torr) | heating temperature (° C.) | heating time (hour) | pressure of nitrogen gas atmosphere (kgf/cm$^2$) | heating temperature (° C.) | heating time (hour) | Kind of nitride | Thickness of nitride (μm) | Tape peeling |
| Example 10 | Mg—Si based Al alloy (A6061) | $1.4 \times 10^{-4}$ | 540 | 2 | 5.0 | 540 | 2 | AlN | 2 | not peeled |
| Example 11 | Mg—Si based Al alloy (A6061) | $1.8 \times 10^{-4}$ | 540 | 2 | 9.5 | 540 | 2 | AlN | 10 | not peeled |
| Example 12 | Mg—Si based Al alloy (A6061) | $1.2 \times 10^{-4}$ | 540 | 4 | 9.5 | 540 | 4 | AlN | 10 | not peeled |
| Example 13 | Mg—Si based Al alloy (A6061) | $8.0 \times 10^{-5}$ | 580 | 2 | 9.5 | 580 | 2 | AlN | 15 | not peeled |
| Example 14 | Cu—Mg based Al alloy (A2024) | $2.2 \times 10^{-4}$ | 575 | 2 | 9.5 | 575 | 2 | AlN | 10 | not peeled |
| Example 15 | Mg based Al alloy (A5083) | $2.0 \times 10^{-4}$ | 575 | 2 | 9.5 | 575 | 2 | AlN | 60 | not peeled |
| Example 16 | Zn—Mg based Al alloy (A7075) | $1.8 \times 10^{-4}$ | 575 | 2 | 9.5 | 575 | 2 | AlN | 18 | not peeled |
| Comparative Example 10 | Mg—Si based Al alloy (A6061) | $4.6 \times 10^{-2}$ | 540 | 2 | 5.0 | 540 | 2 | (**) | (**) | (**) |
| Comparative Example 11 | Mg—Si based Al alloy (A6061) | (*) | (*) | (*) | 9.5 | 540 | 4 | (**) | (**) | (**) |
| Comparative Example 12 | Mg—Si based Al alloy (A6061) | $5.0 \times 10^{-3}$ | 540 | 6 | 9.5 | 540 | 4 | (**) | (**) | (**) |
| Comparative Example 13 | Mg—Si based Al alloy (A6061) | $1.0 \times 10^{-2}$ | 580 | 8 | 9.5 | 580 | 2 | (**) | (**) | (**) |

(*) denotes no heating
(**) denotes no nitride formed

Example 17

(Production of aluminum-containing members)

Example 17 was subjected to the same heating treatment and the same heating/nitriding treatment as in Example 7 except that a Mg—Si based alloy (A6061) having a shape of 50×50×2 mm having a surface with a film of aluminum having a surface coated with an aluminum having a purity of 99.9% in a thickness of 50 μm by flame spraying was used as a substrate.

Inspection of the thus obtained member by the X-ray diffraction and the SEM observation revealed that a film of aluminum nitride was formed in a thickness of 7 μm.

Likewise, the member formed with the aluminum nitride film was subjected to the same heating cycling test and the heating cycling test in the same manner as in the above Examples. As a result, neither occurrence of cracks nor peeling of the aluminum nitride film was observed. That is, it is seen that the aluminum nitride film formed according to this Example has extremely strong adhesion.

Example 18

Example 18 was subjected to the same heating treatment and the same heating/nitriding treatment as in Example 7 except that an Ni based alloy having a shape of 50×50×2 mm and a surface coated with a film of aluminum having a purity of 99.9% in a thickness of 50 μm by flame spraying was used as a substrate.

Inspection of the thus obtained member by the X-ray diffraction and the SEM observation revealed that a film of aluminum nitride was formed in a thickness of 8 μm.

Likewise, the member formed with the aluminum nitride film was subjected to the same heating cycling test and the heating cycling test in the same manner as in the above Examples. As a result, neither occurrence of cracks nor peeling of the aluminum nitride film was observed. That is, it is seen that the aluminum nitride film formed according to this Example has extremely strong adhesion.

Example 19

Example 19 was subjected to the same heating treatment and the same heating/nitriding treatment as in Example 7 except that a composite material having a shape of 50×50×2 mm and composed of 30 wt. % of aluminum and 70 wt. % of aluminum nitride was used as a substrate.

Inspection of the thus obtained member by the X-ray diffraction and the SEM revealed that a film of aluminum nitride was formed in a thickness of 10 μm. Further, peaks attributable to aluminum were decreased and those to aluminum were increased as compared with an X-ray diffraction pattern before the heating treatment and the heating/nitriding treatment.

The member was subjected to the same heating cycling test and the heating cycling test in the same manner as in the above Examples. As a result, neither occurrence of cracks nor peeling of the aluminum nitride film was observed. That is, it is seen that the aluminum nitride film formed according to this Example has extremely strong adhesion.

Example 20

The aluminum-containing member obtained in Example 11 was subjected to a corrosion resistance test.

A mixed gas of $NF_3$ 75 sccm/$N_2$ 100sccm was used, and an RF power 800W was applied to the member at 550° C. under a condition of 0.1 torrs for 5 hours.

Measurement of a change in weight of the aluminum-containing member between before and after the test shows a weight gain of 0.50 g/cm$^2$.

Further, an EDS analysis of the contents of elements of the aluminum-containing member and the nitride was effected at five spots at an acceleration voltage of 20 kV and a magnification of 10000 before the corrosion resistant test. The analysis was effected by using an SEM (Model XL-30) manufactured by Philips Co., Ltd. and an EDS (Model CDU-SUTW) detector manufactured by EDAX Co., Ltd. Results were averaged. For a reference purpose, a JIS standard of the substrate is shown in Table 3. Consequently, the presence ratio of oxygen, Mg and Si is shown in Table 3. The presence ratio in oxygen between the nitride and the substrate is as shown in Table 4.

Example 21

The aluminum-containing member obtained in Example 3 was subjected to a corrosion resistance test in the same manner as in Example 20. As a result, the weight increased by 0.50 g/cm$^2$.

TABLE 3

| | Elementary analysis data of A1-nitrided produce unit wt% | | |
|---|---|---|---|
| | Example 20 | | substrate |
| | nitride | substrate portion | (specified in JIS) |
| O | 1.30 | 2.27 | — |
| Mg | 5.45 | 1.66 | 0.8 ~ 1.2 |
| Si | 4.07 | 0.50 | 0.4 ~ 0.8 |

TABLE 4

| Ratio in nitrided film portion/ substrate portion | A6061 nitrided product (Example 20) |
|---|---|
| O | 0.57 |
| Mg | 3.28 |
| Si | 8.14 |

Comparative Example 14

Pure aluminum was subjected to a corrosion resistance test in the same manner as in Example 20. As a result, the weight increased by 0.50 g/cm$^2$.

Comparative Example 15

An MG—Si based aluminum alloy (A6061) was subjected to a corrosion resistance test in the same manner as in Example 20. As a result, the weight increased by 0.90 g/cm$^2$.

Comparative Example 15

Examples 20 and 21 and Comparative Examples 14 and 15 show that the aluminum-containing member according to the present invention has smaller weight change between the corrosion resistive test and high corrosion resistance against the corrosive gas.

Example 22

By using an aluminum-containing member according to the present invention, a joined product between the aluminum-containing member according to the present invention and a substrate 4 was prepared as a heat-emitting member as shown in FIG. 5.

As the aluminum-containing member 7 was used that in Example 11. As binders 3, 5 was used a brazing agent (JIS BA4004 was used. As the substrate, an aluminum nitride having sides 50 mm and a thickness d of 1 mm with heat conductivity of 150 W.mK was used. The joining condition was 610° C. under vacuum of $10^{-5}$ torrs for 10 minutes with a load of 600 g/cm$^2$.

The above heat-emitting member was subjected to a heating cycling test at 10 cycles each having a condition that the member was heated to 200° C. from room temperature at a heating rate of 10° C./min. in air, held at that temperature for 1 hour, and then cooled to room temperature in four hours.

As a result, no peeling was observed between the aluminum-containing member 7 and the substrate 4, and an excellent joined state was maintained.

Example 23

Example 23 was effected in the same manner as in Example 22 except that as a substrate, silicon nitride having sides 50 mm and a thickness d of 1 mm with heat conductivity of 70 W·mK was used instead of the aluminum nitride substrate. The joining condition was 610° C. under vacuum of $10^{-5}$ torrs for 10 minutes with a load of 600 g/cm$^2$.

The obtained heat-emitting member was subjected to the heating cycling test as in Example 22, which revealed that no peeling was observed between the aluminum-containing member 7 and the substrate 4, and an excellent joined state was maintained.

Although the present invention has been explained in detail in the above based on the embodiments of the invention by reciting the specific Examples, but the invention is not limited to the above contents only. Any modifications, changes and variations can be made without the scope of the claimed invention.

As having been explained above, in the process for producing the aluminum-containing member according to the present invention, the member is heated in vacuum before the substrate onto which a nitrided film is to be formed is heated and nitrided. By so doing, the nitride can be formed on the surface of the substrate by the subsequent heating/nitriding treatment.

According to the aluminum-containing member according to the present invention, the nitride contains at least one element selected from the group consisting of metals of Group 2A, Group 3A, Group 4A and Group 4B in Periodic Table at a higher concentration than that in a metallic aluminum-containing portion in the substrate. Therefore, according to the present invention, the aluminum-containing member that has high hardness and high corrosion resistance which has not been conventionally attained can be obtained.

What is claimed is:

1. A method for producing an aluminum-containing member, said method comprising the steps of heating a substrate containing at least metallic aluminum in a vacuum of not more than $10^{-3}$ torrs in the presence of a material containing a vapor of at least one metal selected from the group consisting of metals of Group 2A, Group 3A, Group 4A, and Group 4B of the Periodic Table, and continuing with the heating step, forming a nitride in a surface portion of the substrate by heating/nitriding the substrate in a nitrogen atmosphere continuously to said heating step.

2. The aluminum-containing member-producing method according to claim 1, wherein the pressure of the vacuum in the heating step is $10^{-3}$ to $10^{-6}$ torrs.

3. The aluminum-containing member-producing method according to claim 1, wherein the heating temperature in the heating treatment is 450 to 650° C.

4. The aluminum-containing member-producing method according to claim 1, wherein a gas pressure of the nitrogen atmosphere in the heating/nitriding step is not less than 1 $kg/cm^2$.

5. The aluminum-containing member-producing method according to claim 4, wherein the gas pressure of the nitrogen atmosphere in the heating/nitriding step is not less than 1 to 2000 $kg/cm^2$.

6. The aluminum-containing member-producing method according to claim 5, wherein the gas pressure of the nitrogen atmosphere in the heating/nitriding step is not less than 1.5 to 9.5 $kg/cm^2$.

7. The aluminum-containing member-producing method according to claim 1, wherein the heating temperature in the heating/nitriding treatment is 450 to 650° C.

8. The aluminum-containing member-producing method according to claim 1, wherein the heating/nitriding step comprises heating and nitriding the substrate in the presence of a material containing a vapor of at least one metal selected from the group consisting of metals of Group 2A, Group 3A, Group 4A and Group 4B in Periodic Table.

* * * * *